US006672665B1

(12) United States Patent
Tseng

(10) Patent No.: US 6,672,665 B1
(45) Date of Patent: Jan. 6, 2004

(54) SWING WITH A SEAT UNIT HAVING A BACKREST FRAME MOVABLE BETWEEN INCLINED AND HORIZONTAL POSITIONS

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/439,392

(22) Filed: May 16, 2003

(51) Int. Cl.[7] ..... A47C 15/00
(52) U.S. Cl. ..... 297/281; 297/376
(58) Field of Search ..... 297/273, 276, 297/278, 280, 281, 282, 376, 377, 354.12, 374

(56) References Cited

U.S. PATENT DOCUMENTS 363,503 A * 5/1887 Bell ..... 297/281
868,640 A * 10/1907 Buch ..... 297/278
924,177 A * 6/1909 Moore ..... 297/130
1,107,341 A * 8/1914 Oldfield ..... 297/278
1,956,772 A * 5/1934 Morton ..... 297/246
2,101,290 A * 12/1937 Pierson ..... 297/130
2,547,891 A * 4/1951 Smith ..... 297/281
4,398,767 A * 8/1983 McGuigan ..... 297/280

* cited by examiner

*Primary Examiner*—Peter R. Brown
(74) *Attorney, Agent, or Firm*—Ladas & Parry

(57) ABSTRACT

A swing includes a seat unit swingably connected to an upright support frame through suspending members. The seat unit includes a seat frame disposed between side frames, a backrest frame pivoted to the seat frame, and a pair of backrest-adjusting units. Each backrest-adjusting unit includes an engaging plate fixed to a respective side frame and formed with an arcuate slot, and a locking screw rod extending through the slot to threadedly engage a threaded hole in the respective backrest frame in such a manner that tightening of the locking screw rod results in securing of the backrest frame to the seat frame at a desired position relative to the seat frame.

2 Claims, 8 Drawing Sheets

SWING WITH A SEAT UNIT HAVING A BACKREST FRAME MOVABLE BETWEEN INCLINED AND HORIZONTAL POSITIONS

BACKGROUND OF THE INVENTION

1. Field of the Invention

The present invention relates to a swing, more particularly to a swing with a seat unit having a backrest frame movable between inclined and horizontal positions.

2. Description of the Related Art

A conventional swing generally includes a seat unit and an upright support frame unit. The support frame unit includes left and right support frames and a transverse rod fixed to top ends of the support frames. The seat unit includes left and right side frames swingably connected to the transverse rod through suspending members. A seat frame is disposed between the left and right side frames, and is fixed to a backrest frame.

SUMMARY OF THE INVENTION

The object of this invention is to provide a swing with a seat unit having a backrest frame movable between inclined and horizontal positions.

According to the present invention, a swing includes a seat unit and an upright support frame. The seat unit includes front and rear connecting rods extending in a longitudinal direction, spaced apart inverted U-shaped left and right side frames extending in a transverse direction relative to the longitudinal direction and having left and right front legs connected to the front connecting rod, and left and right rear legs connected to the rear connecting rod, a seat frame disposed between the Left and right side frames, first and second pivot shafts, the second pivot shaft being disposed at an elevation above the first pivot shaft, a backrest frame extending upwardly from the seat frame, pivoted to the seat frame through the first pivot shaft and to the left and right side frames through the second pivot shaft, and formed with left and right threaded holes, and left and right backrest-adjusting units. Each of the backrest-adjusting units includes an engaging plate fixed to a respective one of the left and right side frames and formed with an arcuate slot that is disposed rearwardly and transversely of the first and second pivot shafts, the arcuate slot having an enlarged upper end disposed above the first and second pivot shafts and a lower end opposite to and disposed below the enlarged upper end, and a locking screw rod having a head, an engaging block reduced from the head, and a threaded shank reduced from the engaging block and extending through the arcuate slot to threadedly engage a respective one of the threaded holes in the backrest frame. The locking screw rod is slidable along the arcuate slot between an upper position, in which the threaded shank extends through the enlarged upper end of the arcuate slot, and a lower position, in which the threaded shank extends through the lower end of the arcuate slot. The engaging block of the locking screw rod is received in and engages the enlarged upper end of the arcuate slot upon tightening of the locking screw rod when the locking screw rod is disposed at the upper position. The upright support frame has opposite top and bottom ends, and left and right suspending members having upper ends connected swingably to the top end of the upright support frame, and lower ends connected swingably and respectively to the left and right side frames of the seat unit.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
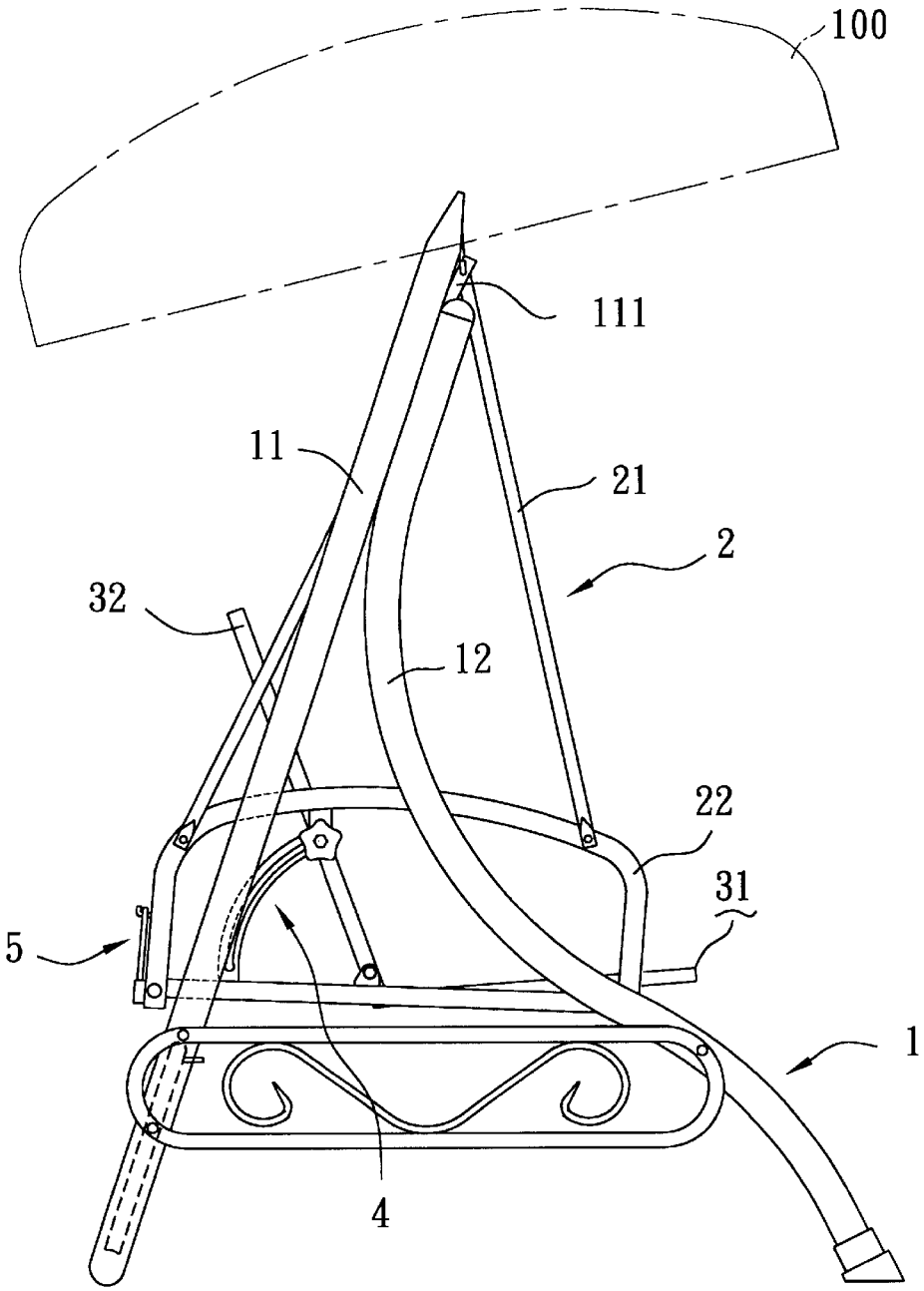
FIG. 1 is a schematic side view of the preferred embodiment of a swing according to the present invention.
Figure 2:
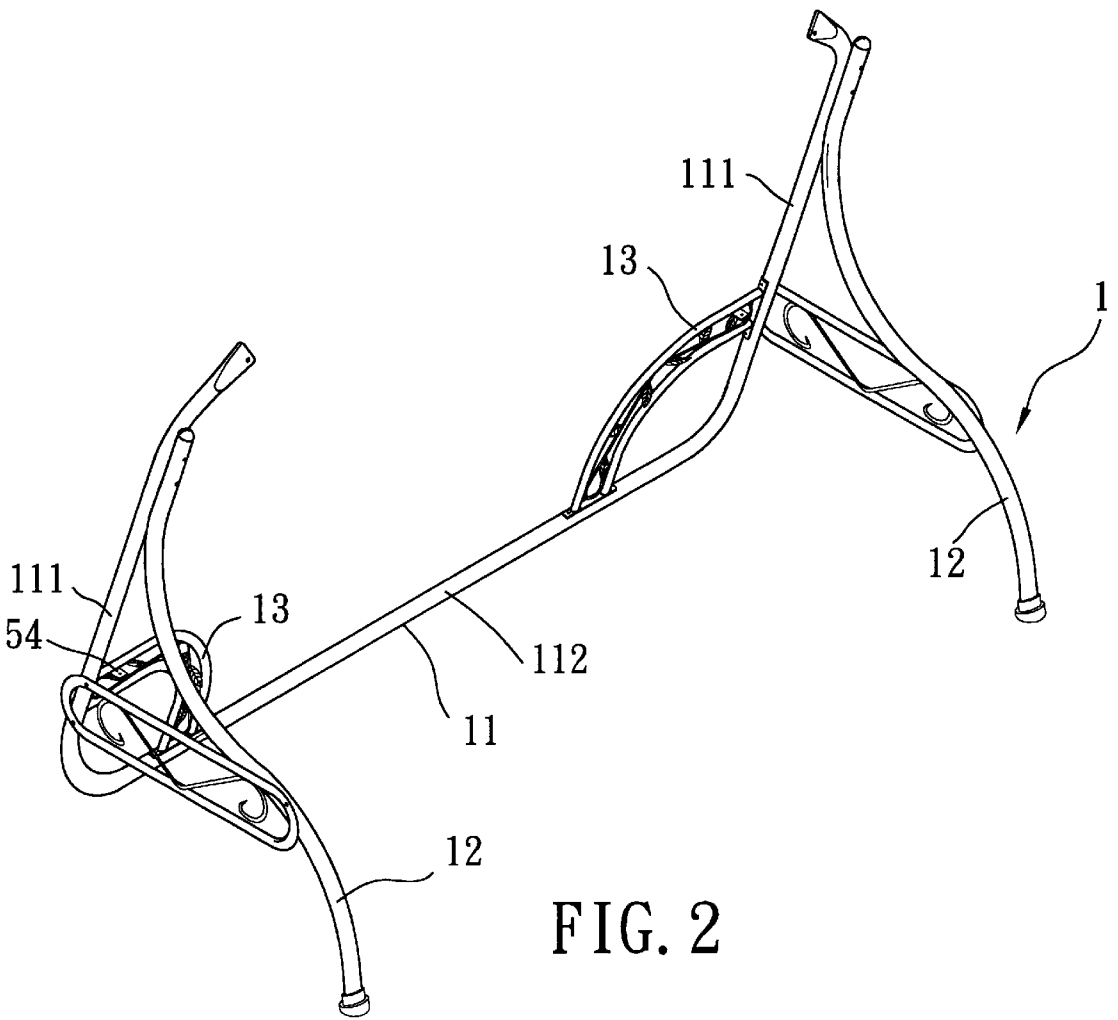
FIG. 2 is a perspective view of an upright support frame of the,preferred embodiment.
Figure 3:
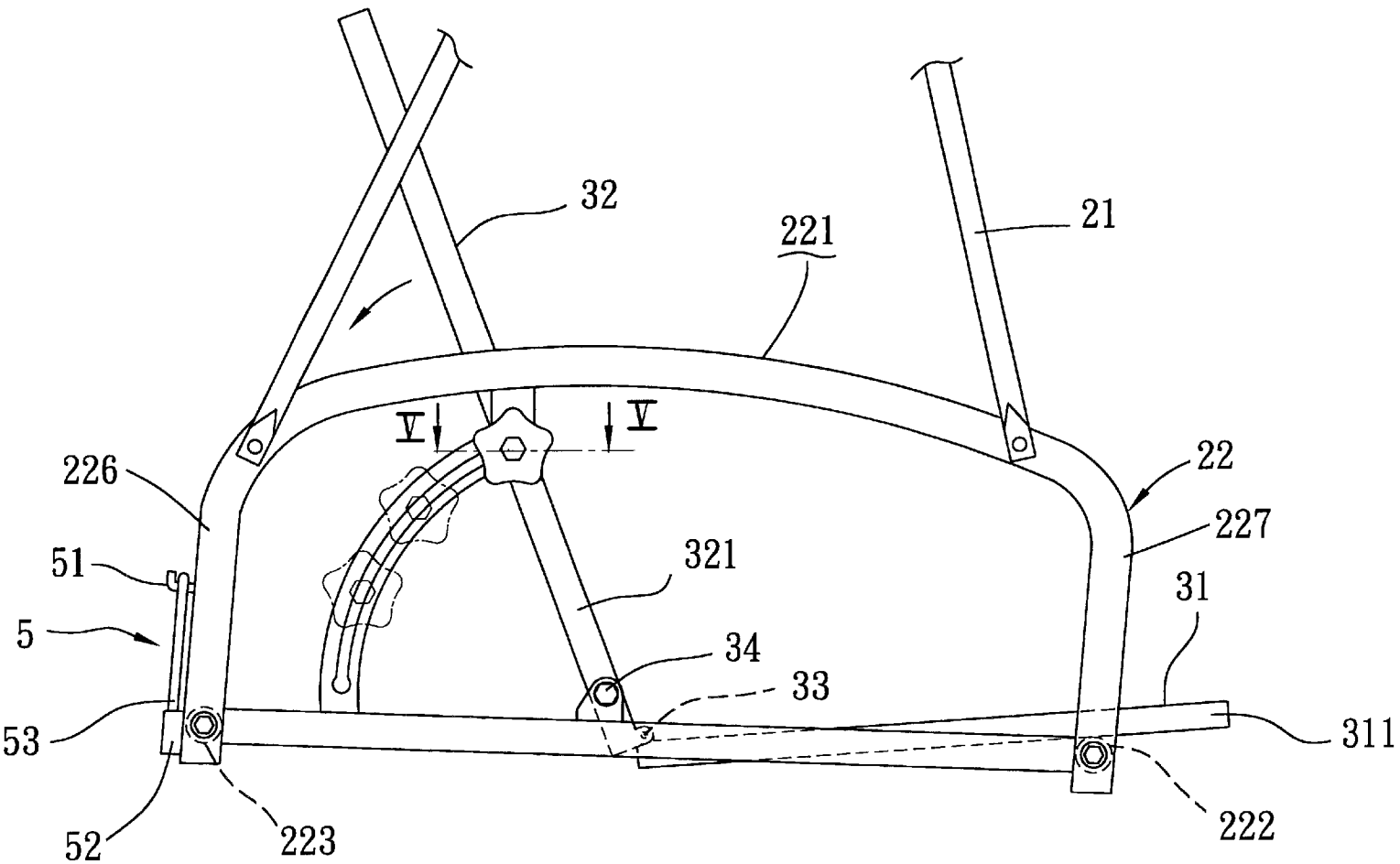
FIG. 3 is a fragmentary view of the preferred embodiment, illustrating how a backrest frame is mounted at a desired position relative to a seat frame.
Figure 4:
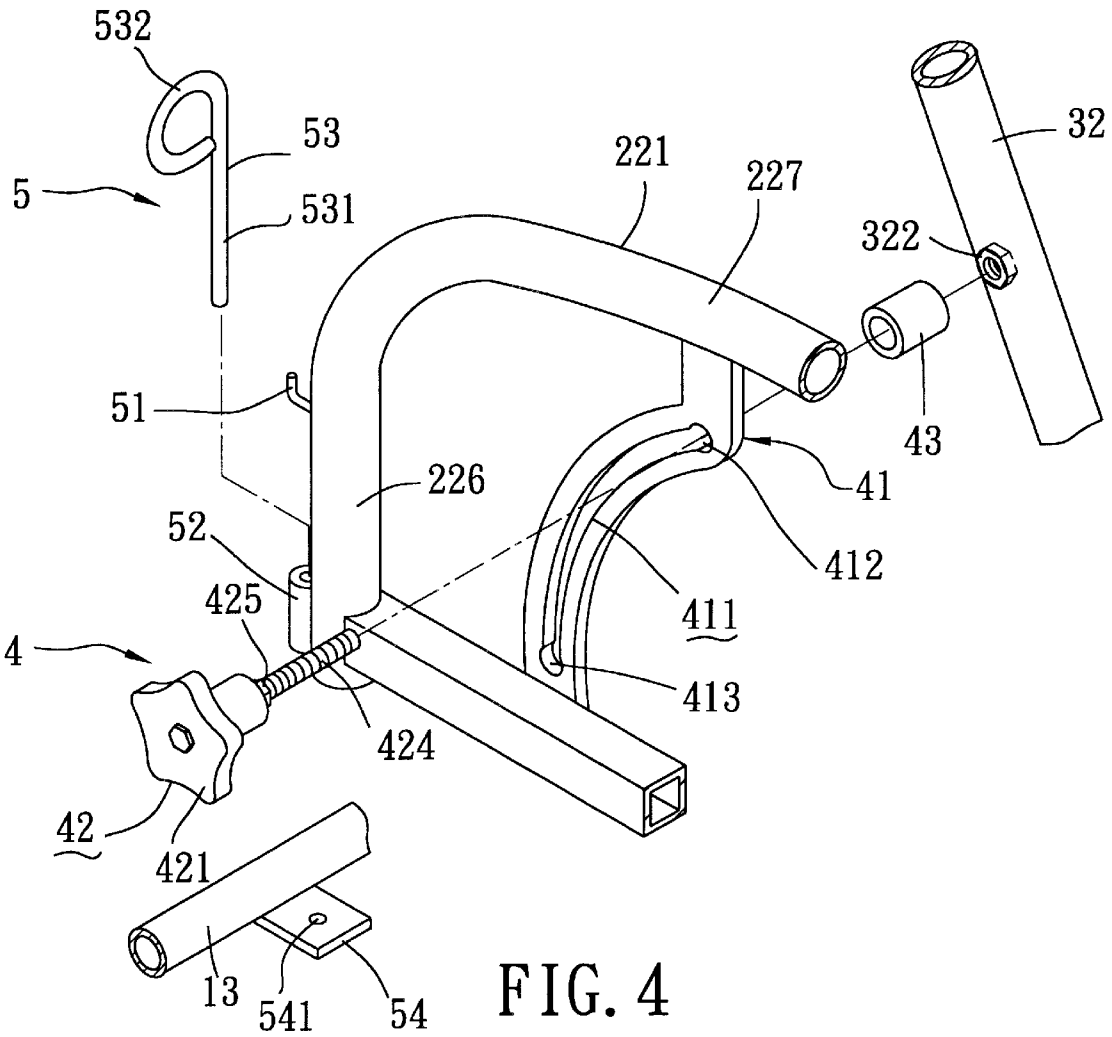
FIG. 4 is a fragmentary partly exploded view of the preferred embodiment taken along lines IV—IV of FIG. 3, illustrating how a backrest-adjusting unit is mounted on a side frame of a seat unit.

Referring to FIGS. 1 to 4, the preferred embodiment of a swing 1 according to the present invention is shown to include a seat unit 2 and an upright support frame 11.

As illustrated, the seat unit 2 includes front and rear connecting rods 222,223 extending in a longitudinal direction, spaced apart inverted U-shaped left and right side frames 22 extending in a transverse direction relative to the longitudinal direction, a seat frame 31, first and second pivot shafts 33, 34, a backrest frame 32, and left and right backrest-adjusting units 4.

The left and right side frames 22 respectively have left and right front legs 227 connected to the front connecting rod 222, and left and right rear legs 226 connected to the rear connecting rod 223.

The seat frame 31 is disposed between the left and right side frames 22.

The backrest frame 32 extends upwardly from the seat frame 31, is pivoted to the seat frame 31 through the first pivot shaft 33 and to the left and right side frames 22 through the second pivot shaft 34, which is parallel to and which is disposed at an elevation above the first pivot shaft 33, and is formed with left and right threaded holes 322.

Each of the left and right backrest-adjusting units 4 includes a locking screw rod 42 and an engaging plate 41. The engaging plate 41 is fixed to a respective one of the left and right side frames 22, and is formed with an arcuate slot 411 that is disposed rearwardly and transversely of the first and second pivot shafts 33, 34. The arcuate slot 411 has an enlarged upper end 412 disposed above the first and second pivot shafts 33, 34 and an enlarged lower end 413 opposite to and disposed below the enlarged upper end 412. The locking screw rod 42 has an enlarged head 421, an engaging block 425 reduced from the head 421, and a threaded shank 424 reduced from the engaging block 425 and extending through the arcuate slot 411 to threadedly engage a respective one of the threaded holes 322 in the backrest frame 32.

Figure 5:
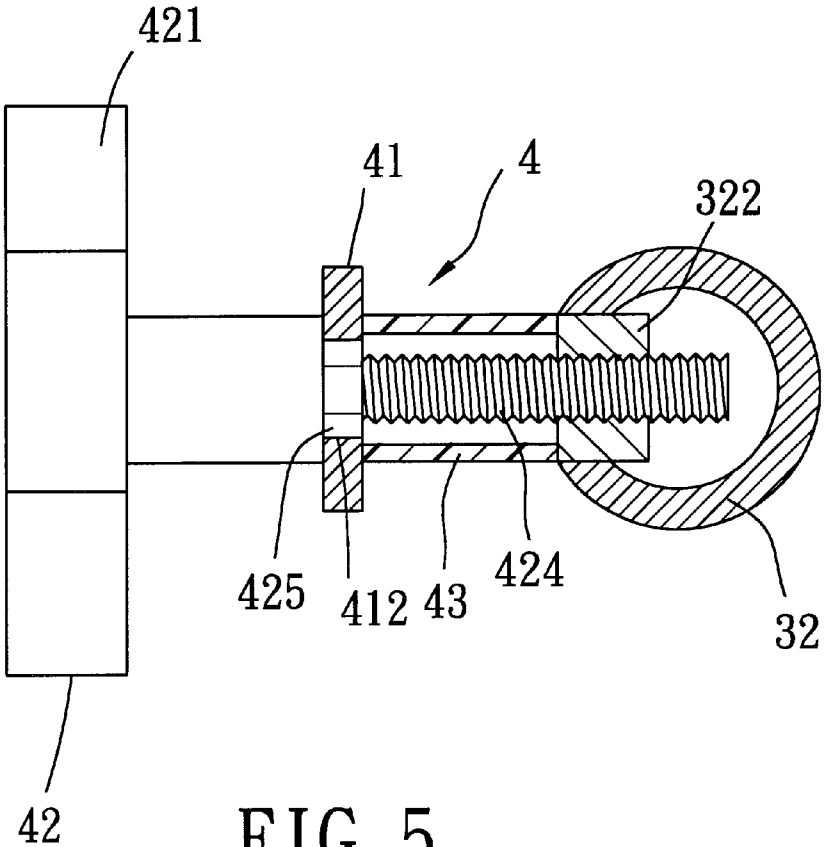
FIG. 5 is a fragmentary sectional view of the preferred embodiment, illustrating a locking screw rod of the backrest-adjusting unit at a tightened position relative to a backrest frame.
Figure 6:
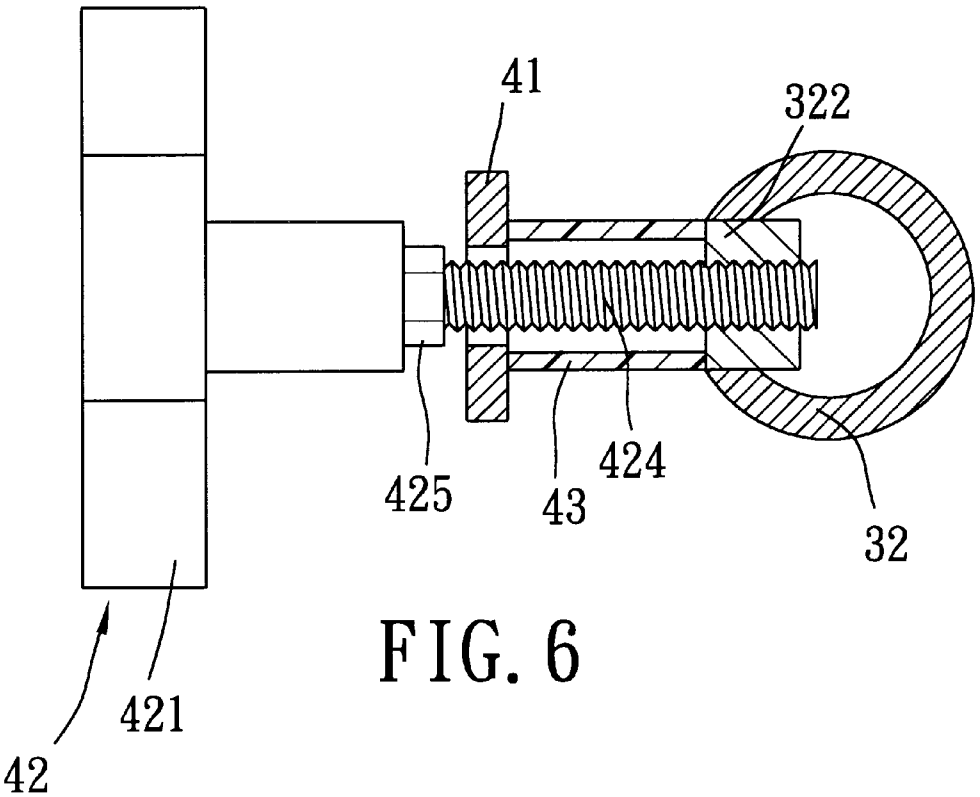
FIG. 6 is a fragmentary sectional view of the preferred embodiment, illustrating the locking screw rod of the backrest-adjusting unit at a loosened position relative to the backrest frame.
Figure 7:
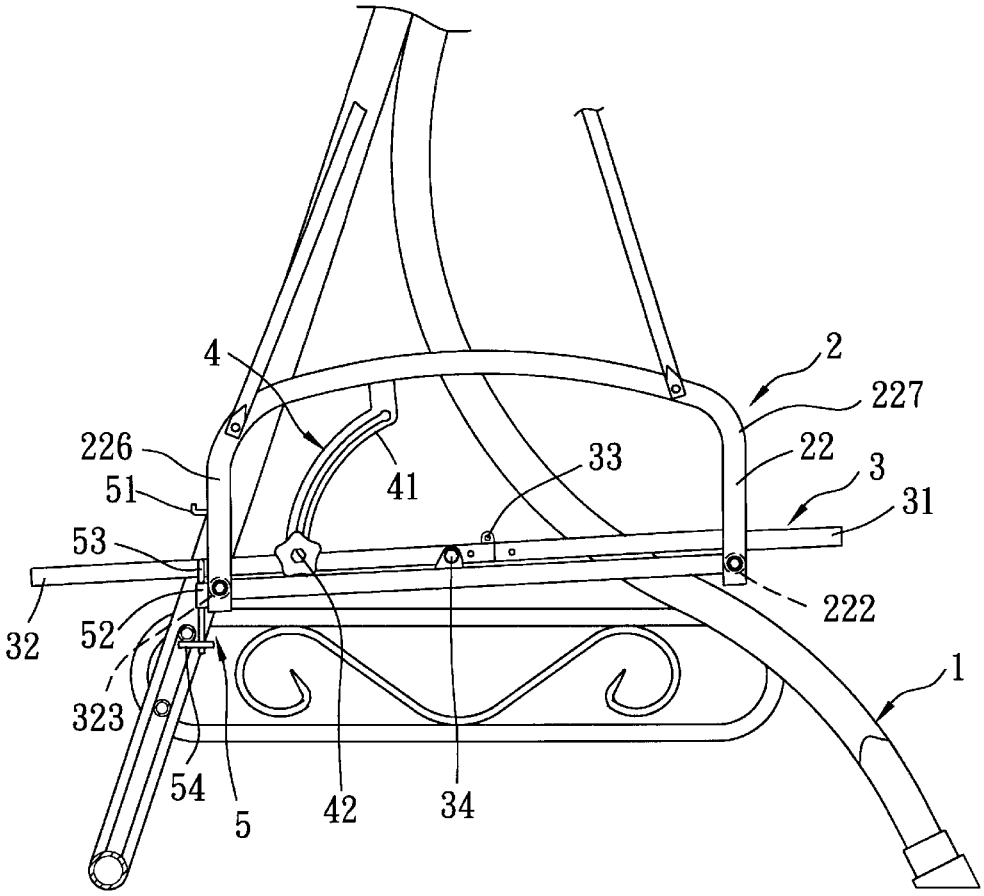
FIG. 7 is a fragmentary schematic side view of the preferred embodiment, illustrating how the backrest frame is locked to the upright support frame when the same is disposed at a horizontal position.

The locking screw rod 42 is slidable along the arcuate slot 411 between an upper position (see FIGS. 3 and 5), in which the threaded shank 424 extends through the enlarged upper end 412 of the arcuate slot 411, a plurality of intermediate positions (shown by dotted lines in FIG. 3), and a lower position (i.e., the horizontal position of FIG. 7). When the locking screw rod 42 is disposed at the upper position, the engaging block 425 of the locking screw rod 42 is received in and engages the enlarged upper end 412 of the arcuate slot 411 (see FIG. 5) upon tightening of the locking screw rod 42 relative to the backrest frame 32, thereby immobilizing the backrest frame 32 relative to the seat frame 31 (see FIG. 3). When the locking screw rod 42 is disposed at one of the intermediate positions, the threaded shank 424 extends through the arcuate slot 411 and the engaging block 425 abuts against the respective engaging plate 41 upon tightening of the locking screw rod 42 relative to the backrest frame 32 so as to firmly position the backrest frame 32 at a desired inclination. When the locking screw rod 42 is disposed at the lower position, the engaging block 425 is received in and engages the enlarged lower end 412 of the arcuate slot 411 (see FIG. 5) upon tightening of the locking screw rod 42 relative to the backrest frame 32, thereby positioning the backrest frame 32 securely at the horizontal position, in which the backrest frame 32 is flush with the seat frame 31, as best shown in FIG. 7. A stopping member 43 is sandwiched between and abuts against the backrest frame 32 and the respective side frame 41 when the engaging block 425 of the locking screw rod 42 is received in the enlarged upper and lower ends 412, 413 of the arcuate slot 411 upon tightening of the locking screw rod 42 for limiting further advancing movement of the locking screw rod 42.

Referring once again to FIG. 2, the upright support frame 11 includes curved left and right front legs 12, and a U-shaped rear frame having a ground-contact portion 112 that is disposed on a ground surface and left and right inclined rear posts 111 that extend inclinedly and upwardly from two opposite ends of the ground-contact portion 112 respectively, and that are connected to top ends of the left and right front legs 12, respectively. Left and right suspending members 21 respectively have upper ends connected swingably to the top end of the support frame 11, and lower ends connected swingably and respectively to armrest portions 221 of the left and right side frames 22. Two reinforcing members 13 respectively interconnect the left and right inclined rear posts 111 and the ground-contact portion 112 so as to enhance strength of the support frame 11. Furthermore, a canopy 100 may be fixed to the top end of the support frame 11.

Figure 8:
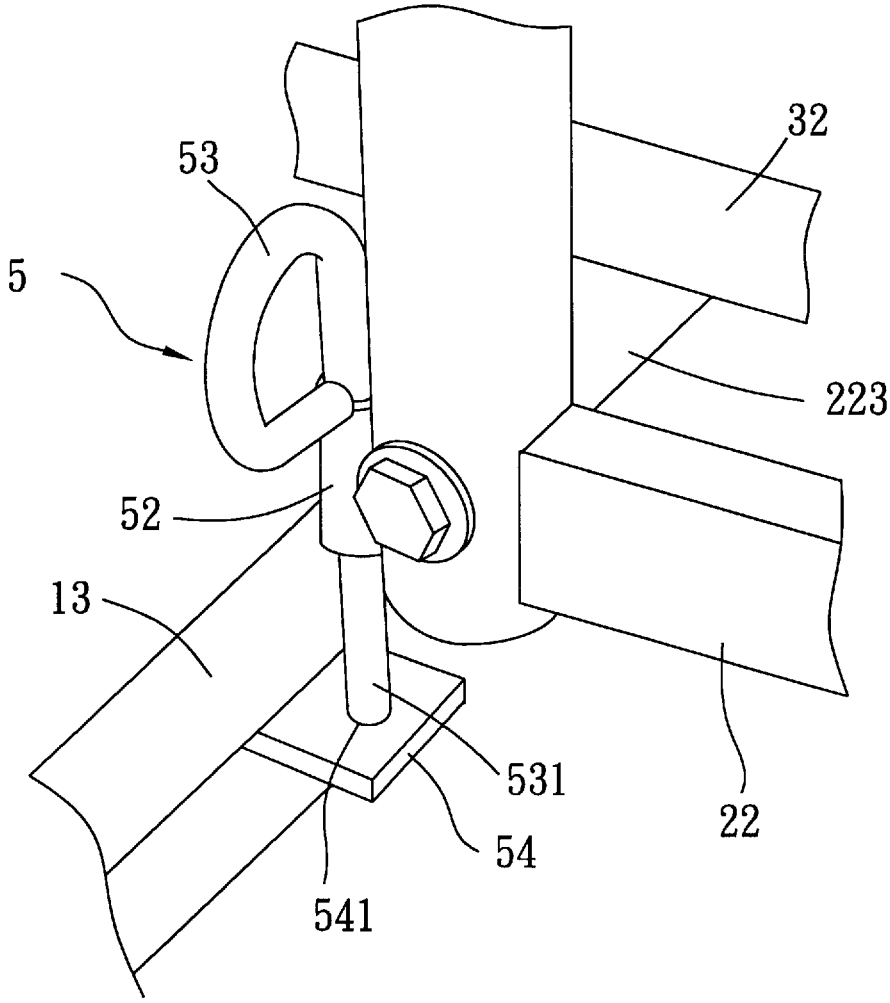
FIG. 8 is an enlarged, fragmentary perspective view of the preferred embodiment, illustrating how the backrest frame is locked to the upright support frame when the same is disposed at the horizontal position.

Referring to FIGS. 7 and 8, the preferred embodiment further includes a locking unit 5 for preventing movement of the seat unit 2 relative to the upright support frame 11. The locking unit 5 preferably includes a tubular holding sleeve 52, a stop plate 54 and an engaging post 53. The tubular holding sleeve 52 is fixed to one of the left and right side frames 22. The stop plate 54 is disposed below the tubular holding sleeve 52, is fixed to a respective one of the reinforcing frames 13, and is formed with an engaging hole 541 which is in vertical alignment with the tubular holding sleeve 52. The engaging post 53 extends into and through the tubular holding sleeve 52, and has a lower end 531 projecting downward from the tubular holding sleeve 52 to engage the engaging hole 541 in the stop plate 54, thereby preventing movement of the seat unit 2 relative to the upright support frame 11. Preferably, the engaging post 53 is formed with an enlarged looped portion 532 (see FIG. 4) to prevent dropping of the same through the tubular holding sleeve 52. When not in use, the engaging post 53 can be hung on an L-shaped hook 51 fixed on the respective side frame 22 by means of the looped portion 532 (see FIG. 4).

With this invention thus explained, it is apparent that numerous modifications and variations can be made without departing from the scope and spirit of this invention. It is therefore intended that the invention be limited only as indicated in the appended claims.

I claim:

1. A swing comprising:

a seat unit including front and rear connecting rods extending in a longitudinal direction, spaced apart inverted U-shaped left and right side frames extending in a transverse direction relative to said longitudinal direction and having left and right front legs connected to said front connecting rod, and left and right rear legs connected to said rear connecting rod, a seat frame disposed between said left and right side frames, first and second pivot shafts, said second shaft being parallel to and disposed at an elevation above said first pivot shaft, a backrest frame extending upwardly from said seat frame, pivoted to said seat frame through said first pivot shaft, to said left and right side frames through said second pivot shaft, and formed with left and right threaded holes, and left and right backrest-adjusting units, each of which includes an engaging plate fixed to a respective one of said left and right side frames and formed with an arcuate slot that is disposed rearwardly and transversely of said first and second pivot shafts, said arcuate slot having an enlarged upper end disposed above said first and second pivot shafts and a lower end opposite to and disposed below said enlarged upper end, and a locking screw rod having a head, an engaging block reduced from said head, and a threaded shank reduced from said engaging block and extending through said arcuate slot to threadedly engage a respective one of said threaded holes in said backrest frame, said locking screw rod being slidable along said arcuate slot between an upper position, in which said threaded shank extends through said enlarged upper end of said arcuate slot, and a lower position, in which said threaded shank extends through said lower end of said arcuate slot, said engaging block of said locking screw rod being received in and engaging said enlarged upper end of said arcuate slot upon tightening of said locking screw rod when said locking screw rod is disposed at said upper position; and an upright support frame having opposite top and bottom ends, and left and right suspending members having upper ends connected swingably to said top end of said upright support frame, and lower ends connected swingably and respectively to said left and right side frames of said seat unit.

2. The swing as defined in claim 1, wherein said seat unit further includes a stopping member that is sandwiched between and that abuts against said engaging plate and said backrest frame when said engaging block is received in said enlarged upper end of said arcuate slot upon tightening of said locking screw rod.

* * * * *